United States Patent [19]

Scarlet

[11] 4,177,750

[45] Dec. 11, 1979

[54] PENNANT AND METHOD OF MAKING A PENNANT

[76] Inventor: Ted Scarlet, 101 Lilac St., Bergenfield, N.J. 07621

[21] Appl. No.: 833,306

[22] Filed: Sep. 14, 1977

[51] Int. Cl.[2] ..... G09F 17/00

[52] U.S. Cl. ..... 116/173; 101/426

[58] Field of Search ..... 116/173; 101/426, 470; 40/2 R

[56] References Cited

U.S. PATENT DOCUMENTS

| | | | |
|---|---|---|---|
| 1,595,395 | 8/1926 | Herbener | 116/173 |
| 2,688,303 | 9/1954 | Leander | 116/173 |
| 2,888,900 | 6/1959 | Scarlet | 116/173 |
| 3,043,732 | 7/1962 | Shepherd | 40/2 R |
| 3,620,881 | 11/1971 | Kannigiesser | 156/230 |
| 3,632,291 | 1/1972 | Defago | 8/2.5 A |
| 3,766,854 | 10/1973 | Scarlet | 116/173 |
| 3,788,269 | 1/1974 | Scarlet | 116/173 |

OTHER PUBLICATIONS

Bhagwat; "Transfer Printing of Textile Fabrics," Feb. 1975; pp. 59-66 of Textile Trends, Feb. 1975.

*Primary Examiner*—S. Clement Swisher
*Assistant Examiner*—Denis E. Corr
*Attorney, Agent, or Firm*—Ralph R. Roberts

[57] ABSTRACT

An improved pennant and a method of producing this pennant is disclosed. Designs are printed on a paper material using an offset printing press. Special dispersal inks are used and applied to the paper. The paper is not special, however, the paper must accept the applied ink without running. The colors are printed in sequence usually the reverse of normal printing with the design in a mirror image. A design (photo, painting, etc.) is reproduced on the face or portion of the pennant. This pennant is made of man-made fiber and die cut to a final size. At the long end of the pennant a perforation is made during die cutting so that it can be folded under or over and after printing this folded portion is sewed to form a tube for the insertion of a stick or rod. The paper is cut by die cutting or a guillotine and along at least one edge must be cut very accurately so that this edge of the paper can act as a guide when placed against an edge of the already cut pennant material. Paired sets are then placed in a transfer press for sixteen seconds at one hundred and eighty degrees Centigrade. The timing and temperature may be adjusted for different requirements. The printed paper is usually slightly larger than the material and the dispersion that occurs during the transfer process appears to the very edge.

4 Claims, 7 Drawing Figures

PENNANT AND METHOD OF MAKING A PENNANT

CROSS REFERENCE TO RELATED PATENTS

Reference is made to U.S. Pat. No. 2,888,900 as issued on June 2, 1959, U.S. Pat. No. 3,766,854 as issued on Oct. 23, 1973, and U.S. Pat. No. 3,788,269 as issued on Jan. 29, 1974. To the extent applicable the above patents, all issued to this applicant, are incorporated by reference.

BACKGROUND OF THE INVENTION

1. Field of the Invention

With reference to the field of art as established in the U.S. Patent and Trademark Office this invention pertains to the general Class entitled, "Signals and Indicators" (Class 116) and more particularly to the subclass entitled, "flags and flagstaffs" (subclass 173) and with reference to the method of making to the general Class of "Printing" (Class 101) and more particularly to the subclass entitled, "special article machines" (subclass 35).

2. Description of the Prior Art

Pennants which depict various scenes with indicia identifying the depicted area are usually produced by a silk-screening process. The present pennant in the transfer to an offset printed master produces a greater detail and fidelity. The pennants often have photo reproductions and multicolored blends not practical in a silk-screened pennant. Manufacturing speed is vastly increased since offset printing is approximately ten times faster than screen printing.

The pennant produced by the present invention is usually made of one hundred percent polyester and is printed from a paper transfer by using special dye dispersal inks applied to the paper by offset printing.

The pennant material is die cut to the final size with an additional lip one inch wide on the long end. At the one inch point it is perforated during the die-cutting process so it can fold under or over depending on the design. The lip also tapers in the opposite direction to compensate for the forward pennant taper. The purpose of this is to have perfect alignment when the lip is folded. The folded area is sewed to allow for the insertion of a stick, rod, etc., to allow the finished product to be displayed or held aloft. Two holes are also incorporated in the die on either side of the perforated line. These holes line up to become one hole after folding. This is used for display hanging by simply pushing out the waste material.

The printing process is known as SUBLISTATIC and for the pennants produced in accordance with the following description I use the word SUBLIME.

SUMMARY OF THE INVENTION

This invention may be summarized at least in part with reference to its objects.

It is an object of this invention to provide, and it does provide, a pennant and a method of making a pennant which has formed at its long end a fold-over portion which has a fold line established by a series of interrupted cuts or perforations. The face of the pennant has a design printed thereon using an offset printing technique for the reproduction of a design (photo, painting, etc.).

It is a further object of this invention to provide, and it does provide, a pennant and a method of making a pennant in which the pennant material is made of man-made fiber and is die cut to the final size intended for use. An additional lip is formed on the large end of the pennant and it is perforated during the die cutting process so that it can be folded over or under after printing. There is also a taper formed on this extending lip and disposed in the opposite direction to compensate for a forward pennant taper. This perforation is intended to provide a near or perfect alignment of the folded lip which is eventually sewed to allow for the insertion of a stick or other similar device. Two aligned holes are also incorporated in this end as the pennant is cut so that these holes line up to become one hole after folding and sewing. These aligned holes are used for display of the pennant on a pin or a nail.

In brief, the pennant of this invention provides an inexpensive product which is easily grouped for display on a pin or a nail in a manner which utilizes the least amount of display space. A tunnel is formed in the end of this pennant for the mounting on a stick or the like. This tunnel is formed from a folded-over portion and is precisely aligned by means of perforations in the pennant. In printing on this pennant, instead of the silk-screening technique usually employed, a design is printed using an offset printing press with special dispersal ink. The design is printed in reverse on a paper transfer. This transfer paper need not be a special paper but only requires that the paper accept the ink without running. The pennant material is, or is substantially, man-made fiber and is die cut to the size intended for the final use. A lip or fold-over portion on the larger end is provided. Folding in the opposite direction to the main pennant provides a tunnel which is stitched after the pennant has been printed. After the design is printed on paper, the paper strip is cut very accurately at least on one edge by means of a die cutting or a guillotine cutter. This edge of the paper provides a guide when placed against one edge of the already cut pennant material. The printed paper is placed upon the pennant material and then is placed in a transfer press for approximately sixteen seconds at approximately one hundred and eighty degrees Centigrade for the transfer of the dispersible ink into the pennant material. The dispersion occurs during the transfer process and usually the design is applied right up to the very edge of the pennant material. Very small pennants when produced, may use printed paper sheets which are transferred to similar size pennant sheets before they are die cut. This die cutting is done after the transfer of the ink onto the pennant material. One of the advantages of this method of making a pennant is that with the photo-offset printing very accurate and elaborate reproductions can and are made of photographic scenes or paintings having a multiplicity of colors so that a blending of color may be produced.

There is an advantage in creating a channel for the insertion of a stick or rod. The channel thus formed not only has a precise and highly decorative strip to blend with the balance of the design but also requires only a single sewing to be performed. This precise fold-over also enables a pair of display mounting holes to be formed in the pennant. These holes align with the fold-over and provide means for displaying the pennant on a pin or nail.

In addition to the above summary the following disclosure is detailed to insure adequacy and aid in understanding of the invention. This disclosure, however, is not intended to prejudice that purpose of a patent which is to cover each variation in form or additions of further improvements. For this reason there has been chosen a specific embodiment of the pennant and method of making a pennant as adopted for use with dispersal inks and showing a preferred means for a heat transfer of these inks into the pennant.

This specific embodiment has been chosen for the purposes of illustration and description as shown in the accompanying drawing wherein:

BRIEF DESCRIPTION OF THE DRAWING

In the following description and in the claims various details are identified by specific names for convenience. These names, however, are intended to be generic in their application. Corresponding reference characters refer to like members throughout the seven figures of the drawing.

Figure 1:
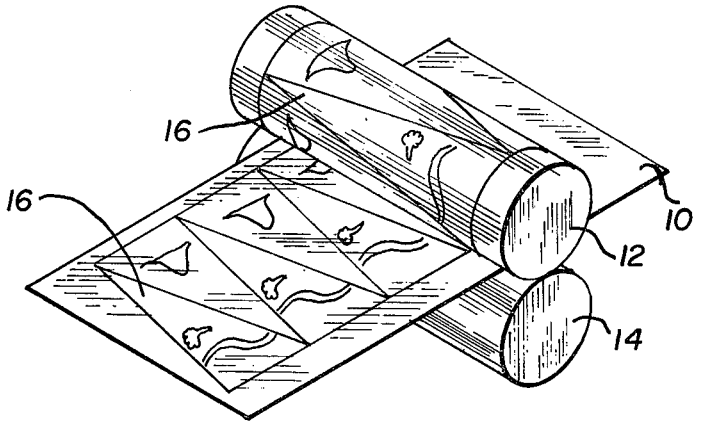
FIG. 1 represents an isometric view and depiction of a photo-offset printing onto a sheet of paper as the transfer paper is being printed with one color of dispersal ink of many that may and often are used.
Figure 2:
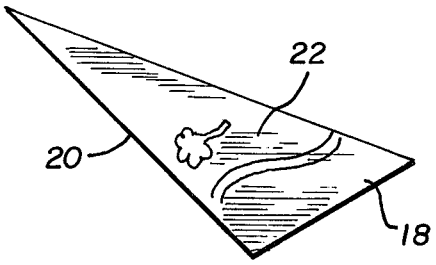
FIG. 2 represents an isometric view of the transfer paper after it has been printed with the series of inks as desired and after die cutting.

The drawing accompanying, and forming part of, this specification discloses certain details of construction for the purpose of explanation but it should be understood that structural details may be modified in various respects without departure from the concept and that the invention may be incorporated in other structural forms than shown.

DESCRIPTION OF THE EMBODIMENT

Referring next to the drawing, there is shown a method and a pennant produced by this method. A sheet of paper 10 is brought to and through upper and lower rollers of an offset printing press. These rollers are indicated as 12 and 14 and are merely diagrammatic representations. Several colors are usually printed on each sheet of paper. Each color is applied accurately by means of the offset printing technique commonly available and dispersal inks apply a design 16 to the sheet of paper 10. Each color is applied by a separate roller or operation. After the desired series of dispersal inks have been applied and the printing is completed, the paper is cut to form a blank 18 with a precise edge 20 formed thereon. The picture of depiction to be applied is in a reverse or mirror image of the printed product and is indicated as 22.

Figure 3:
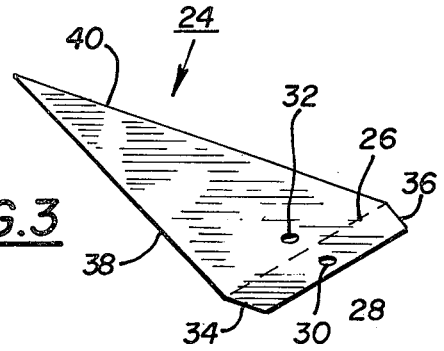
FIG. 3 represents a die cut blank of a pennant before printing.

The pennant material which is a man-made fiber is die cut to a final size, as seen in FIG. 3, and is generally indicated as 24. This pennant material is precisely cut to a determined size and has a perforated upper end which may be approximately one inch from the formed end. These perforations 26 are parallel to and a determined distance such as three-quarters to an inch in from an end 28. A pair of like holes 30 and 32 are formed in this material and are equal distance from the perforated line 26 and are in alignment with each other so that when a fold-over is provided the holes are in coincidence. These holes 30 and 32 are preferably about one-quarter inch in diameter and preferably on or about the center line of the pennant. A reverse bevel is formed as ends 34 and 36. These ends are provided so that when the fold-over is made the ends 34 and 36 coincide with the tapered sloped edges 38 and 40 of the pennant blank 24.

Figure 4:
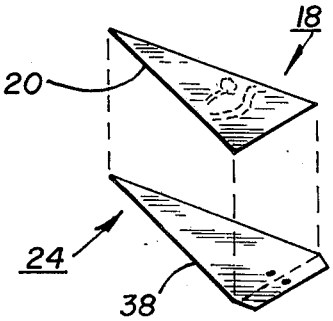
FIG. 4 represents, in a slightly smaller scale, an isometric view depicting the alignment and placement of a printed transfer paper on a pennant blank, the dispersal ink on the transfer paper being positioned in a face-to-face relationship with the face of the pennant.

As seen in FIG. 4, the cut paper blank 18 is laid on the cut pennant material 24 so that edges 20 and 38 are in coincidence and the tips of the blank cut paper and the pennant are in coincidence.

It is also to be noted that the printed transfer may be placed on a large piece of pennant material for printing several pennants at one time. The die cutting of the pennant material is then done after printing. This is particularly desirable when the pennant is of small size.

Figure 5:
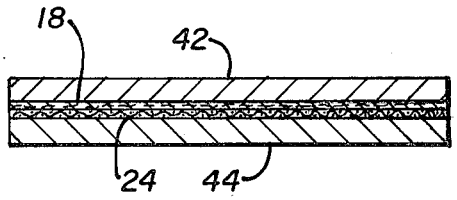
FIG. 5 represents a fragmentary, sectional view showing the printed transfer paper and the pennant blank in a pressed together relationship in a heated transfer press.
Figure 6:
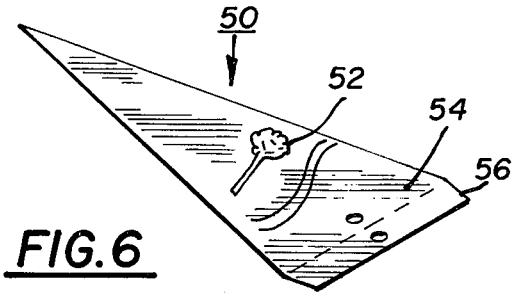
FIG. 6 represents an isometric view of a pennant after it has been removed from the press and the dispersal inks have been transferred to the pennant.
Figure 7:
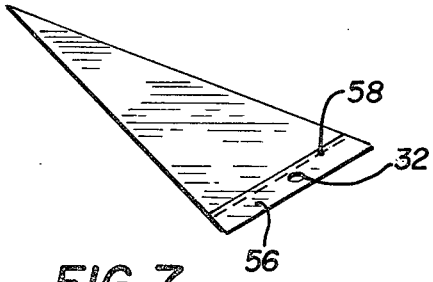
FIG. 7 shows an isometric view of the pennant after a sewing of the fold-over end has been made.

In FIG. 5 is shown the transfer step in which the printed transfer paper 18 is placed on top of the pennant material 24. As depicted, a heated upper platen 42 and a supporting platen 44, usually unheated press the paper and the dispersal ink into engagement with the pennant material. The heat in the upper platen 42 of this transfer press causes a transfer of colored dispersal ink into the pennant material. This contact is generally maintained for about sixteen seconds at one hundred and eighty degrees Centigrade. Timing and temperature may be slightly adjustd for different inks or a difference in the thickness of the dispersal material or pennant. After the transfer of printing has been achieved, as in FIG. 5, the pennant and paper is removed from the press and the paper is stripped from the pennant and discarded, as in FIG. 6. The finished pennant is indicated as 50 and the depicted scene resulting from the transfer of ink is indicated as 52. An upper border portion 54 and 56 may also be printed at this same time. The resulting pennant is seen in FIG. 7 and includes a resulting fold-over portion 56 which has a printed color or design thereon. After the folding over of portion 56, a stitching may be applied to form a tubular portion at the end of the printed and cut pennant.

The pennant and method, above-described, contemplates an accurately printed pennant which is die cut to a selected shape. The long end is formed with a fold-over section which is accurately formed by providing a perforation 26 which acts as a guide for the fold line. As this die cut and perforation are simultaneously made, the holes 30 and 32 are also made so that coincidence of these holes is achieved with the fold-over and sewing. Normally the waste material in these holes is left in place until time for display of the pennant.

A definite advantage of creating a channel for insertion of a stick or rod is that a decorative end which blends with the rest of the design of the pennant is created and provided. The sewing on of separate strips requires double sewing and a resulting mismatch. An alignment of a display hole is not practical and this added strip usually has minimal appeal.

In the above description a method of producing a pennant is disclosed and includes making the pennant of substantially man-made fiber and in sheet material, this pennant when printed and completed having a fold-over end requiring only a single pass of a sewing machine to form a tunnel for the inserting of a stick, rod and the like, said steps for forming the pennant including printing the selected design in the selected sequence of colors in an offset printing press using special dispersal ink on a transfer paper sheet whereat the ink is retained in its applied configuration and without running, this design being a mirror image of the depicted scene; cutting this printed sheet to a selected size with at least one edge precisely formed in relation to the printed design applied thereto to provide a guide edge; providing a sheet of substantially man-made fiber and cutting one edge precisely to form a guide edge; placing the printed and cut transfer paper on the pennant material with the precisely formed edges in coincidence with the ink carrying surface of the transfer paper toward the pennant material; placing the transfer paper and pennant material as a paired set in a transfer press whereat at a given pressure and heat the paper and ink thereon with the pennant material is heated for about sixteen seconds at one hundred and eighty degrees Centigrade; removing the paired sheets from the press and the paper from the now printed pennant; forming an additional lip on the long end of the pennant, this lip foldable at a perforated line formed by a die cutting operation, this additional lip having end portions formed with a taper to match the edges of the pennant when this lip is in a folded condition, and securing this additional lip to the pennant to form a tunnel for the insertion of a rod, stick and the like. Man-made fibers include Nylon (TM E. I. DuPont), acrylic and the like but because of the temperatures involved for the transfer of the dispersal inks polyester is the preferred material. Nylon and acrylic tend to or do soften at these temperatures.

Terms such as "up," "down," "bottom," "top," "front," "back," "in," "out" and the like are applicable to the embodiment shown and described in conjunction with the drawing. These terms are merely for the purpose of description and do not necessarily apply to the position in which the pennant may be constructed or used.

While a particular embodiment of the pennant and the printed transfer of the design has been shown and described it is to be understood the invention is not limited thereto since modifications may be made within the scope of the accompanying claims and protection is sought to the broadest extent the prior art allows.

What is claimed is:

1. An improved pennant made of man-made fiber and having at least one side printed to depict scenes, names, insignias and combinations thereof and the like, the pennant being precision cut from a larger piece of fabric to provide the desired outer configuration, the pennant printed from a transfer member of paper and the like which is printed on one face with and by offset printing using and applying to one face of the transfer member a color sequence of special dye dispersal inks printed as a mirror reproduction of the to be depicted representation, said transfer member cut to provide at least one edge which is accurately positioned with relation to the depicted representation the pennant including (a) a pennant of material of man-made fiber sheet material, the sheet being die cut to provide a precise guide edge along at least one edge of the sheet of material and to provide two ends, one longer than the other; (b) a printed design applied to the face of the pennant, this design applied when and as the printed face of the transfer member is placed in a selected position adjacent to and on the face of the pennant material after which with an application of determined pressure and a heating of about sixteen seconds at one hundred eighty degrees centigrade a transfer design from the transfer paper to the pennant material is achieved; (c) an additional lip portion formed on the long end of the pennant, this lip portion foldable at a perforated line formed at selected distance from and parallel to the end of the pennant, the securing of the lip to form a tunnel being a single pass of a sewing machine; (d) a pair of small holes of like size formed before securing the lip in the pennant material, the holes laying on a common line normal to the perforated line with one on each side of the perforated line and at an equal distance therefrom so that when the lip is secured the holes are substantially in coincidence, and providing means for mounting and supporting the pennant on a pin, nail and the like, and (e) a tunnel formed by securing said lip in a fold-over condition to the pennant material after removal of the transfer paper from the face of the pennant, said tunnel providing a mounting of a stick, rod and the like, the ends of the material being cut so as to not protrude beyond the sides of the pennant after the fold-over and tunnel have been formed.

2. An improved pennant as in claim 1 in which the lip portion and adjacent end portion are decorative and blend with the balance of the design.

3. The method of making a pennant of man-made fiber sheet material, this pennant when printed and completed having a fold-over and requiring only a single pass of a sewing machine to form a tunnel for the inserting of a stick, rod and the like, said steps for forming the pennant printed from a selected design in the selected sequence of colors in an offset printing press using special dispersal ink on a transfer paper sheet whereat the ink is retained in its applied configuration and without running, this design being a mirror image of the depicted scene, the pennant including: (a) cutting this printed sheet to a selected size with at least one edge precisely formed in relation to the printed design applied thereto to provide a guide edge; (b) providing a sheet of man-made fiber and cutting one edge and cutting to form two ends, one longer than the other precisely to form a guide edge; (c) placing the printed and cut transfer paper on the pennant material with the precisely formed edges in coincidence and with the ink carrying surface of the transfer paper toward the pennant material; (d) placing the transfer paper and pennant material as a paired set in a transfer press whereat at a given pressure and heat the paper and ink thereon with the pennant material is heated for about sixteen seconds at one hundred eighty degrees centigrade; (e) removing the paired sheets from the press and the paper from the now printed pennant; (f) forming an additional lip on the long end of the pennant, this lip foldable at a perforated line formed by a die cutting operation, this additional lip having end portions formed with a taper to match the edges of the pennant when this lip is in a folded condition; (g) forming a pair of small holes before securing the lip of like size in the pennant material, said holes laying on a common line normal to the perforated line with one of the holes being on each side of this line and at an equal distance from this perforated line so that when the lip is secured the holes are substantially in coincidence, and providing means for mounting and supporting the pennant on a pin, nail and the like, and (h) securing this additional lip to the pennant to form a tunnel for the insertion of a rod, stick and the like the securing of the tunnel by sewing with a single seam.

4. The method of making a pennant as in claim 3 which includes printing the lip portion and adjacent end portion with a decorative motif that blends with the balance of the design printed on the pennant.

* * * * *